US008584519B2

(12) United States Patent
Maida et al.

(10) Patent No.: US 8,584,519 B2
(45) Date of Patent: Nov. 19, 2013

(54) COMMUNICATION THROUGH AN ENCLOSURE OF A LINE

(75) Inventors: John L. Maida, Houston, TX (US); Etienne M. Samson, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 494 days.

(21) Appl. No.: 12/838,736

(22) Filed: Jul. 19, 2010

(65) Prior Publication Data

US 2012/0013893 A1 Jan. 19, 2012

(51) Int. Cl.
*E21B 47/09* (2012.01)

(52) U.S. Cl.
USPC ..... 73/152.54

(58) Field of Classification Search
USPC ..... 324/220, 221; 367/87; 73/152.54
See application file for complete search history.

(56) References Cited

U.S. PATENT DOCUMENTS

| | | | | |
|---|---|---|---|---|
| 2,201,311 | A | | 5/1940 | Halliburton |
| 2,210,417 | A | | 8/1940 | Kinley |
| 2,242,161 | A | | 5/1941 | Athy et al. |
| 2,739,475 | A | | 3/1956 | Nowak |
| 2,803,526 | A | | 8/1957 | Nowak |
| 3,480,079 | A | | 11/1969 | Guinn et al. |
| 3,854,323 | A | | 12/1974 | Hearn et al. |
| 3,864,969 | A | | 2/1975 | Smith, Jr. |
| 4,046,220 | A | | 9/1977 | Glenn, Jr. |
| 4,208,906 | A | | 6/1980 | Roberts, Jr. |
| 4,295,739 | A | | 10/1981 | Meltz et al. |
| 4,330,037 | A | | 5/1982 | Richardson et al. |
| 4,410,041 | A | | 10/1983 | Davies et al. |
| 4,495,411 | A | * | 1/1985 | Rashleigh ..... 250/227.19 |
| 4,520,666 | A | | 6/1985 | Coblentz et al. |
| 4,575,260 | A | | 3/1986 | Young |
| 4,641,028 | A | | 2/1987 | Taylor et al. |

(Continued)

FOREIGN PATENT DOCUMENTS

| | | | |
|---|---|---|---|
| CA | 2320394 | A1 | 4/2001 |
| CA | 2626596 | A1 | 7/2008 |

(Continued)

OTHER PUBLICATIONS

Sierra, J., Kaura, J., Gualtieri, D., Glasbergen, G., Sarkar, D.,and Johnson, D.; "DTS Monitoring Data of Hydraulic Fracturing: Experiences and Lessons Learned," SPE 116182, Sep. 21-24, 2008, Denver, Colorado.

(Continued)

*Primary Examiner* — John Fitzgerald
(74) *Attorney, Agent, or Firm* — Smith IP Services, P.C.

(57) ABSTRACT

A communication system can include a transmitter which transmits a signal, and at least one sensing device which receives the signal, the sensing device including a line contained in an enclosure, and the signal being detected by the line through a material of the enclosure. A sensing system can include at least one sensor which senses a parameter, at least one sensing device which receives an indication of the parameter, the sensing device including a line contained in an enclosure, and a transmitter which transmits the indication of the parameter to the line through a material of the enclosure. Another sensing system can include an object which displaces in a subterranean well. At least one sensing device can receive a signal from the object. The sensing device can include a line contained in an enclosure, and the signal can be detected by the line through a material of the enclosure.

38 Claims, 7 Drawing Sheets

(56) References Cited

U.S. PATENT DOCUMENTS 4,678,865 A * 7/1987 Sherwin ..... 174/36
4,703,175 A 10/1987 Salour et al.
4,714,342 A 12/1987 Jackson et al.
4,832,121 A 5/1989 Anderson
4,845,616 A 7/1989 Phillips
4,927,232 A * 5/1990 Griffiths ..... 385/13
4,976,142 A 12/1990 Perales
5,163,321 A 11/1992 Perales
5,182,779 A 1/1993 D'Agostino et al.
5,194,847 A 3/1993 Taylor et al.
5,249,251 A 9/1993 Egalon et al.
5,252,918 A 10/1993 VanBerg et al.
5,271,675 A 12/1993 Fagan et al.
5,303,207 A * 4/1994 Brady et al. ..... 367/134
5,323,856 A 6/1994 Davis et al.
5,326,969 A 7/1994 Fagan et al.
5,380,995 A 1/1995 Udd et al.
5,451,772 A 9/1995 Narendran
5,488,224 A 1/1996 Fagan et al.
5,509,474 A 4/1996 Cooke, Jr.
5,557,406 A 9/1996 Taylor et al.
5,610,583 A * 3/1997 Drebika et al. ..... 340/566
5,641,956 A 6/1997 Vengsarkar et al.
5,675,674 A 10/1997 Weis
5,696,863 A 12/1997 Kleinerman
5,825,804 A 10/1998 Sai
5,845,033 A 12/1998 Berthold et al.
5,862,273 A 1/1999 Pelletier
5,892,860 A 4/1999 Maron et al.
6,003,376 A * 12/1999 Burns et al. ..... 73/584
6,004,639 A 12/1999 Quigley et al.
6,018,501 A * 1/2000 Smith et al. ..... 367/134
6,026,911 A 2/2000 Angle et al.
6,041,860 A 3/2000 Nazzal et al.
6,072,567 A * 6/2000 Sapack ..... 356/32
6,082,454 A 7/2000 Tubel
6,233,374 B1 5/2001 Ogle et al.
6,233,746 B1 5/2001 Skinner
6,241,028 B1 * 6/2001 Bijleveld et al. ..... 175/40
6,253,848 B1 * 7/2001 Reimers et al. ..... 166/254.1
6,281,489 B1 8/2001 Tubel et al.
6,302,204 B1 * 10/2001 Reimers et al. ..... 166/250.03
6,354,147 B1 3/2002 Gysling et al.
6,367,332 B1 * 4/2002 Fisher et al. ..... 73/649
6,380,534 B1 4/2002 Farhadiroushan et al.
6,408,943 B1 6/2002 Schultz et al.
6,437,326 B1 8/2002 Yamate et al.
6,443,228 B1 * 9/2002 Aronstam et al. ..... 166/250.11
6,531,694 B2 3/2003 Tubel et al.
6,542,683 B1 4/2003 Evans et al.
6,557,630 B2 5/2003 Harkins et al.
6,585,042 B2 7/2003 Summers
6,588,266 B2 7/2003 Tubel et al.
6,590,647 B2 7/2003 Stephenson
6,618,677 B1 9/2003 Brown
6,691,584 B2 2/2004 Gysling et al.
6,745,833 B2 * 6/2004 Aronstam et al. ..... 166/250.11
6,751,556 B2 6/2004 Schroeder et al.
6,788,063 B1 * 9/2004 Peterson et al. ..... 324/322
6,789,424 B2 * 9/2004 Knudsen et al. ..... 73/514.26
6,789,621 B2 9/2004 Wetzel et al.
6,802,373 B2 10/2004 Dillenbeck et al.
6,828,547 B2 12/2004 Tubel et al.
6,913,079 B2 7/2005 Tubel
6,920,395 B2 7/2005 Brown
6,935,425 B2 * 8/2005 Aronstam ..... 166/250.11
6,976,535 B2 * 12/2005 Aronstam et al. ..... 166/250.11
6,977,367 B2 12/2005 Tubel et al.
6,978,832 B2 12/2005 Gardner et al.
6,981,549 B2 1/2006 Morales et al.
6,992,048 B2 1/2006 Reddy et al.
6,997,256 B2 2/2006 Williams et al.
7,000,696 B2 2/2006 Harkins
7,021,146 B2 4/2006 Nash et al.
7,040,390 B2 5/2006 Tubel et al.
7,055,604 B2 6/2006 Jee et al.
7,066,256 B2 6/2006 Dillenbeck et al.
7,066,284 B2 6/2006 Wylie et al.
7,077,200 B1 7/2006 Adnan et al.
7,086,484 B2 8/2006 Smith, Jr.
7,140,435 B2 11/2006 Defretin et al.
7,140,437 B2 11/2006 McMechan et al.
7,168,311 B2 1/2007 Zisk, Jr. et al.
7,251,384 B2 7/2007 Da Silva Junior et al.
7,256,706 B2 * 8/2007 Haase et al. ..... 340/854.3
7,282,697 B2 10/2007 Thomas et al.
7,315,666 B2 1/2008 Van Der Spek
7,328,624 B2 2/2008 Gysling et al.
7,345,953 B2 3/2008 Crickmore et al.
7,357,021 B2 4/2008 Blacklaw
7,398,680 B2 7/2008 Glasbergen et al.
7,430,903 B2 10/2008 Ramos
7,458,273 B2 12/2008 Skinner et al.
7,475,724 B2 1/2009 Pribnow et al.
7,479,878 B2 * 1/2009 Maki et al. ..... 340/566
7,504,618 B2 3/2009 Hartog et al.
7,580,797 B2 8/2009 Akram et al.
7,617,873 B2 11/2009 Lovell et al.
7,721,822 B2 * 5/2010 Krueger et al. ..... 175/57
7,730,774 B2 6/2010 Glasbergen et al.
7,752,953 B2 7/2010 Sokol et al.
7,753,118 B2 7/2010 Ramakrishnan et al.
7,753,119 B2 7/2010 Chen et al.
7,753,120 B2 7/2010 Keller
7,753,122 B2 7/2010 Curlett
7,754,660 B2 7/2010 Putzig
7,755,235 B2 7/2010 Main
7,755,971 B2 7/2010 Heatley et al.
7,755,972 B2 7/2010 Yogeswaren et al.
7,755,973 B2 7/2010 Tello
7,779,683 B2 8/2010 Glasbergen et al.
7,797,996 B2 9/2010 Bostick, III
7,946,341 B2 * 5/2011 Hartog et al. ..... 166/254.1
7,995,198 B2 8/2011 Sasaoka et al.
8,020,616 B2 * 9/2011 Greenaway ..... 166/254.2
8,098,063 B2 * 1/2012 Paulson ..... 324/220
8,225,867 B2 * 7/2012 Hartog et al. ..... 166/250.01
8,245,780 B2 8/2012 Fidan et al.
8,291,975 B2 * 10/2012 Roddy et al. ..... 166/255.1
8,397,810 B2 * 3/2013 Verret et al. ..... 166/250.12
8,408,064 B2 * 4/2013 Hartog et al. ..... 73/643
2001/0020675 A1 9/2001 Tubel et al.
2002/0040963 A1 4/2002 Clayton et al.
2002/0064331 A1 5/2002 Davis et al.
2002/0119271 A1 8/2002 Quigley et al.
2002/0122176 A1 9/2002 Haas et al.
2002/0174728 A1 11/2002 Beresford et al.
2003/0094281 A1 5/2003 Tubel
2003/0145654 A1 * 8/2003 Knudsen et al. ..... 73/488
2003/0166470 A1 9/2003 Fripp et al.
2003/0173959 A1 * 9/2003 Paulson et al. ..... 324/220
2003/0192692 A1 * 10/2003 Tubel ..... 166/250.15
2003/0205083 A1 11/2003 Tubel et al.
2003/0236626 A1 12/2003 Schroeder et al.
2004/0040707 A1 3/2004 Dusterhoft et al.
2004/0069069 A1 * 4/2004 Gysling et al. ..... 73/736
2004/0084180 A1 5/2004 Shah et al.
2004/0109228 A1 6/2004 Aronstam
2005/0087344 A1 * 4/2005 Toekje et al. ..... 166/375
2005/0120796 A1 6/2005 Nash et al.
2005/0145018 A1 * 7/2005 Sabata et al. ..... 73/49.1
2005/0149264 A1 7/2005 Tarvin et al.
2005/0224229 A1 10/2005 Blacklaw
2006/0010973 A1 1/2006 Brown
2006/0071158 A1 4/2006 Van Der Spek
2006/0109746 A1 5/2006 Crickmore et al.
2006/0133203 A1 6/2006 James et al.
2006/0165344 A1 * 7/2006 Mendez et al. ..... 385/13
2006/0272809 A1 12/2006 Tubel et al.
2006/0283266 A1 * 12/2006 Qing et al. ..... 73/862.041
2007/0012872 A1 * 1/2007 Poland et al. ..... 250/227.14
2007/0120051 A1 5/2007 DiFoggio et al.
2007/0234788 A1 10/2007 Glasbergen
2007/0234789 A1 10/2007 Glasbergen et al.

(56) References Cited

U.S. PATENT DOCUMENTS

| | | | | |
|---|---|---|---|---|
| 2008/0053658 | A1* | 3/2008 | Wesson et al. | 166/297 |
| 2008/0068586 | A1 | 3/2008 | Kishida et al. | |
| 2008/0088846 | A1 | 4/2008 | Hayward et al. | |
| 2008/0134775 | A1 | 6/2008 | Pipchuk et al. | |
| 2008/0142212 | A1* | 6/2008 | Hartog et al. | 166/250.01 |
| 2008/0181554 | A1 | 7/2008 | Taverner et al. | |
| 2008/0204008 | A1* | 8/2008 | Paulson | 324/220 |
| 2009/0114386 | A1 | 5/2009 | Hartog et al. | |
| 2009/0132183 | A1 | 5/2009 | Hartog et al. | |
| 2009/0188665 | A1* | 7/2009 | Tubel et al. | 166/250.01 |
| 2009/0211754 | A1* | 8/2009 | Verret et al. | 166/250.12 |
| 2009/0326826 | A1 | 12/2009 | Hull et al. | |
| 2010/0107754 | A1* | 5/2010 | Hartog et al. | 73/152.47 |
| 2010/0122813 | A1 | 5/2010 | Trummer et al. | |
| 2010/0139386 | A1 | 6/2010 | Taylor | |
| 2010/0175467 | A1 | 7/2010 | Difoggio et al. | |
| 2010/0175873 | A1 | 7/2010 | Milkovisch et al. | |
| 2010/0175875 | A1 | 7/2010 | Becker et al. | |
| 2010/0175877 | A1 | 7/2010 | Parris et al. | |
| 2010/0175880 | A1 | 7/2010 | Wang et al. | |
| 2010/0175889 | A1 | 7/2010 | Gartz et al. | |
| 2010/0175895 | A1 | 7/2010 | Metcalfe | |
| 2010/0177310 | A1 | 7/2010 | Difoggio | |
| 2010/0177595 | A1 | 7/2010 | Khare et al. | |
| 2010/0177596 | A1 | 7/2010 | Fink et al. | |
| 2010/0179076 | A1 | 7/2010 | Sullivan et al. | |
| 2010/0179077 | A1 | 7/2010 | Turakhia et al. | |
| 2010/0200743 | A1* | 8/2010 | Forster et al. | 250/254 |
| 2010/0200744 | A1* | 8/2010 | Pearce et al. | 250/268 |
| 2010/0207019 | A1 | 8/2010 | Hartog et al. | |
| 2010/0219334 | A1 | 9/2010 | Legrand et al. | |
| 2010/0254650 | A1 | 10/2010 | Rambow | |
| 2011/0002795 | A1 | 1/2011 | Brookbank | |
| 2011/0030467 | A1 | 2/2011 | Bakulin | |
| 2011/0088462 | A1 | 4/2011 | Samson et al. | |
| 2011/0090496 | A1 | 4/2011 | Samson et al. | |
| 2011/0185807 | A1* | 8/2011 | Albrecht et al. | 73/152.57 |
| 2011/0185815 | A1 | 8/2011 | McCann | |
| 2011/0186290 | A1* | 8/2011 | Roddy et al. | 166/253.1 |
| 2011/0187556 | A1* | 8/2011 | Roddy et al. | 340/853.3 |
| 2011/0188344 | A1 | 8/2011 | Hartog et al. | |
| 2011/0192592 | A1* | 8/2011 | Roddy et al. | 166/250.01 |
| 2011/0192593 | A1* | 8/2011 | Roddy et al. | 166/250.01 |
| 2011/0192594 | A1* | 8/2011 | Roddy et al. | 166/250.01 |
| 2011/0192597 | A1* | 8/2011 | Roddy et al. | 166/253.1 |
| 2011/0192598 | A1* | 8/2011 | Roddy et al. | 166/253.1 |
| 2011/0199228 | A1* | 8/2011 | Roddy et al. | 340/856.4 |
| 2011/0255367 | A1* | 10/2011 | Howlid et al. | 367/17 |
| 2011/0273296 | A1* | 11/2011 | Laase et al. | 340/572.1 |
| 2011/0277544 | A1* | 11/2011 | Rytlewski et al. | 73/152.18 |
| 2011/0311179 | A1* | 12/2011 | Greenaway | 385/12 |
| 2012/0014211 | A1 | 1/2012 | Maida et al. | |
| 2012/0057432 | A1* | 3/2012 | Hill et al. | 367/81 |
| 2012/0060615 | A1* | 3/2012 | Farhadiroushan et al. | 73/655 |
| 2012/0063267 | A1* | 3/2012 | Hill et al. | 367/82 |
| 2012/0092960 | A1* | 4/2012 | Gaston et al. | 367/35 |
| 2012/0111104 | A1* | 5/2012 | Taverner et al. | 73/152.16 |
| 2012/0177319 | A1 | 7/2012 | Alemohammad et al. | |
| 2012/0179390 | A1 | 7/2012 | Kimmiau et al. | |

FOREIGN PATENT DOCUMENTS

| | | | |
|---|---|---|---|
| EP | 1464204 | A1 | 12/2002 |
| EP | 0910725 | B1 | 7/2003 |
| EP | 1355166 | A2 | 10/2003 |
| EP | 1355169 | A2 | 10/2003 |
| EP | 1357401 | A2 | 10/2003 |
| EP | 1468258 | A2 | 10/2004 |
| EP | 1464204 | B1 | 4/2005 |
| EP | 1563323 | B1 | 3/2007 |
| EP | 1466138 | B1 | 4/2009 |
| EP | 1468258 | B1 | 4/2010 |
| EP | 1552490 | B1 | 7/2010 |
| GB | 2230086 | A | 10/1990 |
| GB | 2243210 | A | 10/1991 |
| GB | 2362462 | A | 11/2001 |
| GB | 2364380 | A | 1/2002 |
| GB | 2364381 | A | 1/2002 |
| GB | 2364384 | A | 1/2002 |
| GB | 2367890 | A | 4/2002 |
| GB | 2384108 | A | 7/2003 |
| GB | 2384313 | A | 7/2003 |
| GB | 2384644 | A | 7/2003 |
| GB | 2386625 | A | 9/2003 |
| GB | 2386687 | A | 9/2003 |
| GB | 2397648 | A | 7/2004 |
| GB | 2408327 | A | 5/2005 |
| GB | 2408328 | A | 5/2005 |
| GB | 2408329 | A | 5/2005 |
| GB | 2408531 | A | 6/2005 |
| GB | 2446285 | A | 8/2008 |
| GB | 2457278 | A | 8/2009 |
| SU | 1294985 | A | 3/1987 |
| WO | 9609461 | A1 | 3/1996 |
| WO | 9609561 | A1 | 3/1996 |
| WO | 9850681 | A1 | 11/1998 |
| WO | 03021301 | A2 | 3/2003 |
| WO | 03042498 | A1 | 5/2003 |
| WO | 03059009 | A1 | 7/2003 |
| WO | 03062750 | A1 | 7/2003 |
| WO | 03062772 | A2 | 7/2003 |
| WO | 03081186 | A2 | 10/2003 |
| WO | 03062772 | A3 | 12/2003 |
| WO | 03081186 | A3 | 12/2003 |
| WO | 03106940 | A1 | 12/2003 |
| WO | 2004020774 | A2 | 3/2004 |
| WO | 2004020789 | A2 | 3/2004 |
| WO | 2004020790 | A2 | 3/2004 |
| WO | 2004042425 | A1 | 5/2004 |
| WO | 2004042425 | A8 | 8/2004 |
| WO | 2004081509 | A1 | 9/2004 |
| WO | 2004085795 | A1 | 10/2004 |
| WO | 2004094961 | A1 | 11/2004 |
| WO | 2004114487 | A1 | 12/2004 |
| WO | 2005035943 | A1 | 4/2005 |
| WO | 2005064117 | A1 | 7/2005 |
| WO | 2005116388 | A1 | 12/2005 |
| WO | 2008098380 | A1 | 8/2008 |
| WO | 2008119951 | A2 | 10/2008 |
| WO | 2009048683 | A2 | 4/2009 |
| WO | 2009077867 | A2 | 6/2009 |
| WO | 2009088816 | A8 | 7/2009 |
| WO | 2008119951 | A3 | 11/2009 |
| WO | 2010020781 | A1 | 2/2010 |
| WO | 2010020795 | A1 | 2/2010 |
| WO | 2010020796 | A1 | 2/2010 |
| WO | 2010078615 | A1 | 7/2010 |
| WO | 2010080132 | A1 | 7/2010 |
| WO | 2010080255 | A2 | 7/2010 |
| WO | 2010080353 | A2 | 7/2010 |
| WO | 2010080366 | A1 | 7/2010 |
| WO | 2010080380 | A1 | 7/2010 |
| WO | 2010080473 | A1 | 7/2010 |
| WO | 2010080727 | A2 | 7/2010 |

OTHER PUBLICATIONS

International Search Report with Written Opinion issued Jul. 4, 2011 for International Patent Application No. PCT/GB2010/001949, 15 pages.

Sierra, Jose; Kaura, Jiten; Welldynamics; Gualtieri, Dan; Glasbergen, Gerard; Sarkar, Diptadhas; Halliburton; Johnson, David; Digital Ascension; "DTS Monitoring Data of Hydraulic Fracturing: Experiences and Lessons Learned", SPE 116182, dated 2008, 15 pages.

Horn, R.N.; Stanford U; Perrick, J.L.; Pruett Indurstries Inc.; and Barua, J.; "The Use of Microcomputers in Well Test Data Acquisition and Analysis", SPE 15308, dated 1986, 9 pages.

Soliman, M.Y.; Halliburton; "Technique for Considering Fluid Compressibility and Temperature Changes in Mini-Frac Analysis", SPE 15370, dated 1986, 11 pages.

Lee, W.S.; Halliburton; "Study of the Effects of Fluid Rheology on Minifrac Analysis", SPE 16916, dated 1987, 10 pages.

(56) References Cited

OTHER PUBLICATIONS

Bjornstad, B.; Norge, Alcatel Kabel; Kvisteroy, T.; Sensonor AS; Eriksrud, M.; "Fibre Optic Well Monitoring System", SPE 23147, dated 1991, 8 pages.
Cleary, M.P.; Massachusetts Inst. of Technology; Johnson, D.E.; Resources Engineering Systems Inc.; Kogsbell, H-H.; Owens, K.A.; Maersk Olie & Gas A.S.; Perry, K.F.; Gas Research Inst.; Pater, C.J. de; Delft U. of Technology; Stachel, Alfred; Schmidt, Holger; RWE-DEA Akitiengesellschaft Fur Mineraloel & Chemie; Tambini, Mauro; AGIP SPA; "Field Implementation of Proppant Slugs to Avoid Premature Screen-Out of Hydraulic Fractures with Adequate Proppant Concentration", SPE 25892, dated 1993 16 pages.
Botto, Giovanni; Maggioni, Bruno; Schenato, Adelmo; AGIP SPA; "Electronic, Fiber-Optic Technology: Future Options for Permanent Reservoir Monitoring", SPE 28484, dated 1994, 10 pages.
Karaman, Osama S.; Chevron Use Production Company, Inc.; Kutlik, Roy L.; Chevron Research and Technology Company; Kluth, Ed L.; Sensor Dynamics Ltd.; "A Field Trial to Test Fiber Optice Sensors for Downhole Temperature and Pressure Measurements, West Coalinga Field, California", SPE 35685, dated 1996, 7 pages.
Saputelli, Luigi; Mendoza, Humberto; Finol, Jose; Rojas, Luis; Lopez, Elias; Bravo, Heriberto; Buitriago, Saul; PDVSA Exploration Y Production; "Monitoring Steamflood Performance through Fiber Optic Temperature Sensing", SPE 54104, dated 1999, 7 pages.
Carnahan, B.D.; Clanton, R.W.; Koehler, K.D.; Aera Energy LLC; Harkins, G.O.; Williams, G.R.; Sensor Highway; "Fiber Optic Temperature Monitoring Technology", SPE 54599, dated 1999, 10 pages.
Eriksson, Klas; ABB Corporate Research AS; "Fibre Optic Sensing—Case of 'Solutions Looking for Problems'", SPE 71829, dated Sep. 4-7, 2001, 5 pages.
Callison, Dave; Jones, Joe; Occidental of Eolk Hills, Inc.; Shelley, Bob; Lockman, Rusty; Hallibruton; "Integrated Modeling of a Field of Wells—An Evaluation of Western Shallow Oil Zone Completion Practices in the Elk Hills Feild, Kern County, California", SPE 76724, dated May 20-22, 2002, 10 pages.
Corbett, Gary; Fagervik, Egil; Christie, Stewart; Smith, Bob; Falcon, Keith; "Fiber Optic Monitoring in Openhole Gravel Pack Completions", SPE 77682, dated Sep. 29-Oct. 2, 2002, 14 pages.
Brown, George A.; Hartog, Arthur; Slumberger; "Optical Fiber Sensors in Upstream Oil & Gas", SPE 79080, dated Nov. 2002, 3 pages.
Brown, G.; Storer, D.; McAlliser, K; Raghaven, K.; "Monitoring Horizontal Producers and Injectors During Cleanup and Production Using Fiber-Optic-Distributed Temperature Measurements", SPE 84379, dated Oct. 5-8, 2003, 6 pages.
Johnson, D.O.; Sugianto, R.; Mock, P.H.; Jones, C.H.; "Identification of Steam-Breakthrough Interval with DTS Technology", SPE 87631, Dec. 9, 2003, 8 pages.
Foucault, H.; Poilleux, D.; Djurisic, A.; Slikas, M.; Strand, J.; Silva, R.; "A Successful Experience for Fiber Optic and Water Shut Off on Horizontal Wells with Slotted Liner Completion in an Extra Heavy Oil Field" SPE 89405, dated Apr. 17-21, 2004, 6 pages.
Hasebe, Brant; Hall, Dr. Andrew; Smith, Bruce; Brady, Jerry; Mehdizadeh, Dr. Parviz; "Feild Qualification of Four Multiphase Flowmeters on North Slop, Alaska", SPE 90037, Sep. 26-29, 2004, 13 pages.
Bond, Andy; Blount, Curt; Kragas, Tor; Mathias, Steve; "Use of a Fiber Optic Pressure/ Temperature guage in an Exploration Well to Minimize Formation Damage Potential and Reduce Costs During Production Testing", SPE 90130, dated Sep. 26-29, 2004, 10 pages.
Ouyang, Liang-Biao; Belanger, Dave; Cheveron Texaco Energy Technology Company; "Flow Profiling via Distributed Temperature Sensor (DTS) System—Expectation and Reality", SPE 90541, dated Sep. 26-29, 2004, 14 pages.
Nath, D.K.; Halliburton; "Fiber Optics Used to Support Reservoir Temperature Surveillance in Duri Steamflood", SPE 93240, dated Apr. 5-7, 2005, 9 pages.
Glasbergen, G.; Batenburg, D. van; Domelen, M. van; Gdansk!, R.; "Field Validation of Acidizing Wormhole Models", SPE 94695, May 25-27, 2005, 11 pages.
Brown, G.; Carvalho, V.; Wray, A.; Sanchez, A.;Guiterrez, G.; "Slickline With Fiber-Optic Distributed Temperature Monitoring for Water-Injection and Gas Lift Systems Optimization in Mexico", dated Jun. 20-23, 2005, 10 pages.
Yoshioka, K.; Zhu, D.; Hill, A.D.; Dawkrajai, P.; L.W. Lake; "A Comprehensive Model of Temperature Behavior in a Horizontal Well", SPE 95656, dated Oct. 9-12, 2005, 15 pages.
Gao, G.; Jalali, Y.; "Interpretation of Distributed Temperature Data During Injection Period in Horizontal Wells", SPE 96260, dated Oct. 9-12, 2005, 8 pages.
Pimenov, V.; Brown, G.; Shandrygin, A.; Popov, Y.; "Injectivity Profiling in Horizontal Wells Through Distributed Temperature Monitoring", SPE 97023, Oct. 9-12, 2005, 8 pages.
Nath, D.K.; Sugianto, Riki; Finley, Doug; "Fiber-Optic Distributed Temperature Sensing Technology Used for Reservoir Monitoring in an Indonesia Steam Flood", SPE 97912, dated Nov. 1-3, 2006, 10 pages.
Clanton, R.W.; Haney, J.A.; Wahl, C.L.; Goiffon, J.J.; Gualtieri, D.; "Real-Time Monitoring of Acid Stimulation Using a Fiber-Optic DTS System", SPE 100617, dated May 8-10, 2006, 10 pages.
John Fagley, et al, "An Improved Simulation for Interpreting Temperature Logs in Water Injection Wells", dated Oct. 1982, 10 pages.
American Petroleum Institute, "Temperature Surveys; The Art of Interpretation", Horace Kading, John S. Hutchings; dated Mar. 1969, 20 pages.
Geothermal Resources Council Transactions, "Temperature Profile Monitoring in Geothermal Wells by Distributed Temperature Sensing Technique", vol. 19, Oct. 1995, 4 pages.
J. Henninges, et al., "Fibre-optic Temperature Measurements in Boreholes", dated Oct. 2003, 9 pages.
Halliburton, "StimWatch Stimulation Monitoring Service", dated 2006, 4 pages.
Terry Knott, "Wytch Farm Sees the Light", Oil Online, dated Dec. 1, 2000, 7 pages.
The Oil and Gas Journal, "Shut-in Temperature Profiles Tell Where the Water Went", Horace Kading, dated May 1968, 3 pages.
Schlumberger, Oilfield Glossary, "Joule-Thomson", dated Mar. 2006, 1 page.
Halliburton, "Reservoir Performance Monitoring", dated Nov. 2005, 2 pages.
Petroleum Transactions, "The Estimation of Water Injection Profiles from Temperature Surveys", T.J. Nowak, dated 1953, 10 pages.
World Geothermal Congress, "Temperature Logging by the Distributed Temperature Sensing Technique during Injection Tests", pp. 1657-1661, dated Jun. 2000, 5 pages.
Stephan Groβwig, et al., "Distributed Fibre Optical Temperature Sensing Technique—A Variable Tool for Monitoring Tasks," Proceedings of the 8th International Symposium on Temperature and Thermal Measurements in Industry and Science, dated Jun. 2001, 9 pages.
Eckart Hurtig, et al., "Fibre Optic Temperature Measurements", Terrastock 2000, dated Aug.-Sep. 2000, 9 pages.
World Geothermal Congress, "Delineation of Fractured Reservoir by Transient Temperature Analysis Using Fiber Optic Sensor", pp. 2617-2621, dated Jun. 2000, 5 pages.
Halliburton, "The Impact of Wellbore Phenomena on Fluid Placement and Zonal Coverage," Gerard Glasbergen, undated, 9 pages.
Oxy Elk Hills, "Using Fiber Optics to Divert Acid on the Fly in the Monterey Shale", Ray Clanton, undated, 46 pages.
Pruett Industries, "Fiber Optic Distributed Temperature Sensor 'DTS'", undated, 51 pages.
Wikipedia, Convolution, web archive, dated Jun. 23, 2010, 14 pages.
Prof. Tom O'Haver, Deconvolution, web archive, dated Jul. 14, 2008, 3 pages.
Ikeda, Fractured Reservoir Management by Fiber Optic Distribution Temperature Measurement, dated Sep. 27-28, 2000, 6 pages.
Wikipedia; "Nyquist Frequency", online encyclopedia, dated Jul. 11, 2010, 3 pages.
Wikipedia; "Nyguist-Shannon Sampling Theorem" online encyclopedia, dated Jul. 17, 2010, 13 pages.
International Search Report with Written Opinion issued Jan. 30, 2013 for PCT Patent Application No. PCT/GB11/001085, 2 pages.

(56) References Cited

OTHER PUBLICATIONS

International Search Report with Written Opinion issued Dec. 18, 2012 for PCT Patent Application No. PCT/GB11/001068, 12 pages.
International Search Report with Written Opinion issued Jan. 30, 2013 for PCT Patent Application No. PCT/GB11/001085, 12 pages.
Partial Search Report issued Apr. 7, 2011 for International application No. PCT/GB2010/001949, 5 pages.
E. Oran Brigham; "The Fast Fourier Transform", Prentice-Hall, dated 1974, 7 pages.
Brigham, E. Oran; "Convolution and Correlation", The Fast Fourier Transform, Published Nov. 28, 1973, Prentice-Hall, 25 pages.
International Search Report and Written Opinion issued Dec. 13, 2012 for PCT Application No. PCT/GB2011/001068, 12 pages.
Russian Office Action issued 10 Jun. 2013 for Russian Patent Application No. 2013107010/20(010445), 3 pages.

* cited by examiner

COMMUNICATION THROUGH AN ENCLOSURE OF A LINE

BACKGROUND

This disclosure relates generally to equipment utilized and operations performed in conjunction with a subterranean well and, in an example described below, more particularly provides for communication through an enclosure of a line.

It is typically necessary to contain lines used in subterranean wells within enclosures (such as insulation, protective conduits, armored braid, optical fiber jackets, etc.), in order to prevent damage to the lines in the well environment, and to ensure that the lines function properly. Unfortunately, the enclosures must frequently be breached to form connections with other equipment, such as sensors, etc.

Therefore, it will be appreciated that improvements are needed in the art, with the improvements providing for communication across enclosures of lines in a well. Such improvements would be useful for communicating sensor measurements, and for other forms of communication, telemetry, etc.

SUMMARY

In the disclosure below, systems and methods are provided which bring improvements to the art of communication in subterranean wells. One example is described below in which acoustic signals are transmitted from a transmitter to a line through a material of an enclosure containing the line. Another example is described below in which a sensor communicates with a line, without a direct connection being made between the line and the sensor.

In one aspect, the present disclosure provides to the art a communication system. The communication system can include a transmitter which transmits a signal, and at least one sensing device which receives the signal. The sensing device includes a line contained in an enclosure. The signal is detected by the line through a material of the enclosure.

A sensing system is also provided to the art by this disclosure. The sensing system can include at least one sensor which senses a parameter, at least one sensing device which receives an indication of the parameter, with the sensing device including a line contained in an enclosure, and a transmitter which transmits the indication of the parameter to the line through a material of the enclosure.

In another aspect, a method of monitoring a parameter sensed by a sensor is provided. The method can include positioning a sensing device in close proximity to the sensor, and transmitting an indication of the sensed parameter to a line of the sensing device. The indication is transmitted through a material of an enclosure containing the line.

In yet another aspect, a method of monitoring a parameter sensed by a sensor can include the steps of positioning an optical waveguide in close proximity to the sensor, and transmitting an indication of the sensed parameter to the optical waveguide, with the indication being transmitted acoustically through a material of an enclosure containing the optical waveguide.

In a further aspect, a sensing system 12 described below includes an object which displaces in a subterranean well. At least one sensing device receives a signal from the object. The sensing device includes a line (such as an electrical line and/or optical waveguides) contained in an enclosure, and the signal is detected by the line through a material of the enclosure.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
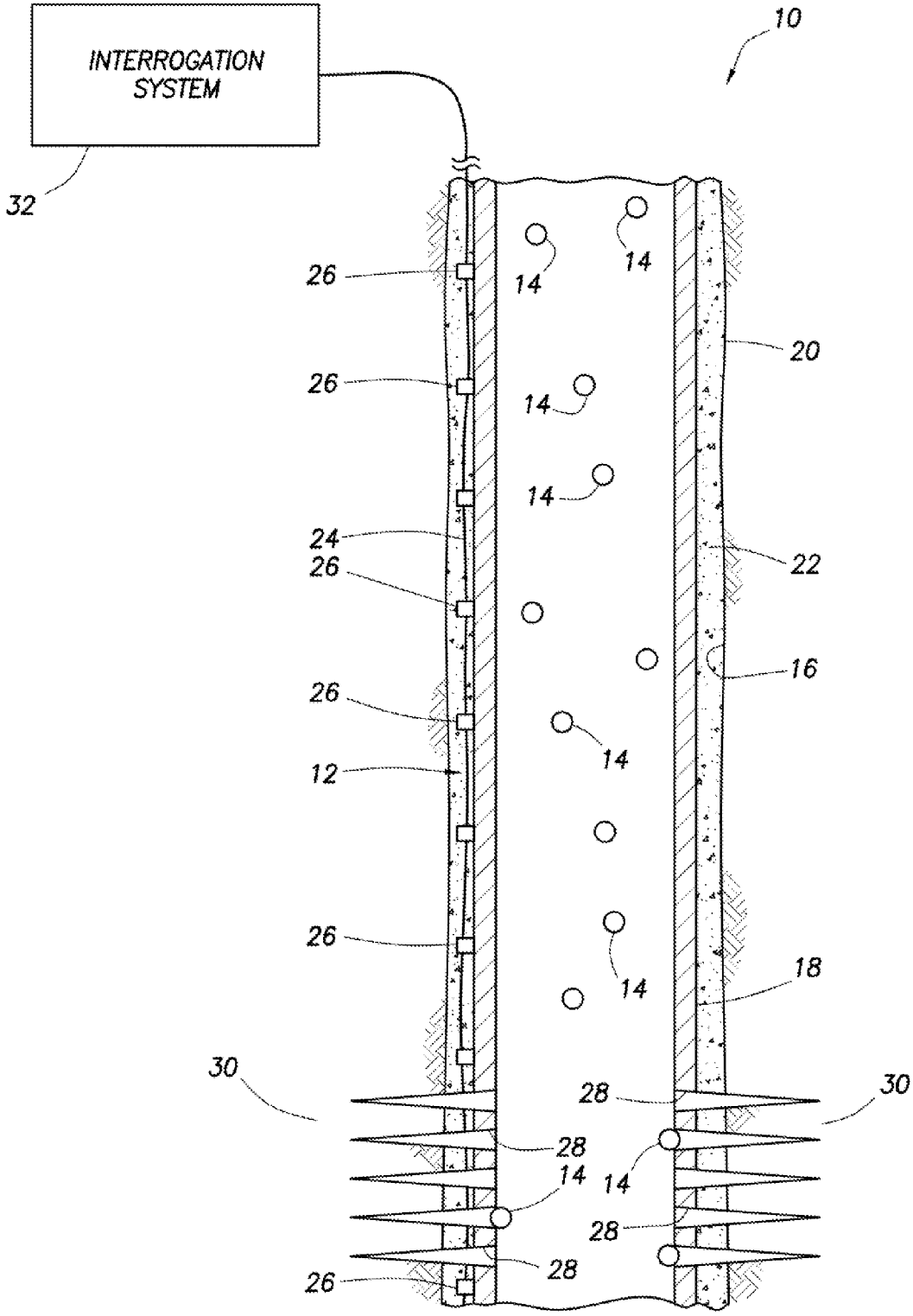
FIG. 1 is a schematic cross-sectional view of a well system and associated method embodying principles of the present disclosure.

Representatively illustrated in FIG. 1 is a well system 10 and associated method which embody principles of this disclosure. In the system 10 as depicted in FIG. 1, a sensing system 12 is used to monitor objects 14 displaced through a wellbore 16. The wellbore 16 in this example is lined with casing 18 and cement 20.

As used herein, the term "cement" is used to indicate a hardenable material which is used to seal off an annular space in a well, such as an annulus 22 formed radially between the wellbore 16 and casing 18. Cement is not necessarily cementitious, since other types of materials (e.g., polymers, such as epoxies, etc.) can be used in place of, or in addition to, a Portland type of cement. Cement can harden by hydrating, by passage of time, by application of heat, by cross-linking, and/or by any other technique.

As used herein, the term "casing" is used to indicate a generally tubular string which forms a protective wellbore lining. Casing may include any of the types of materials known to those skilled in the art as casing, liner or tubing. Casing may be segmented or continuous, and may be supplied ready for installation, or may be formed in situ.

The sensing system 12 comprises at least one sensing device 24, depicted in FIG. 1 as comprising a line extending along the wellbore 16. In the example of FIG. 1, the sensing device 24 is positioned external to the casing 18, in the annulus 22 and in contact with the cement 20.

In other examples, the sensing device 24 could be positioned in a wall of the casing 18, in the interior of the casing, in another tubular string in the casing, in an uncased section of the wellbore 16, in another annular space, etc. Thus, it should be understood that the principles of this disclosure are not limited to the placement of the sensing device 24 as depicted in FIG. 1.

The sensing system 12 may also include sensors 26 longitudinally spaced apart along the casing 18. However, preferably the sensing device 24 itself serves as a sensor, as described more fully below. Thus, the sensing device 24 may be used as a sensor, whether or not the other sensors 26 are also used.

Figure 6:
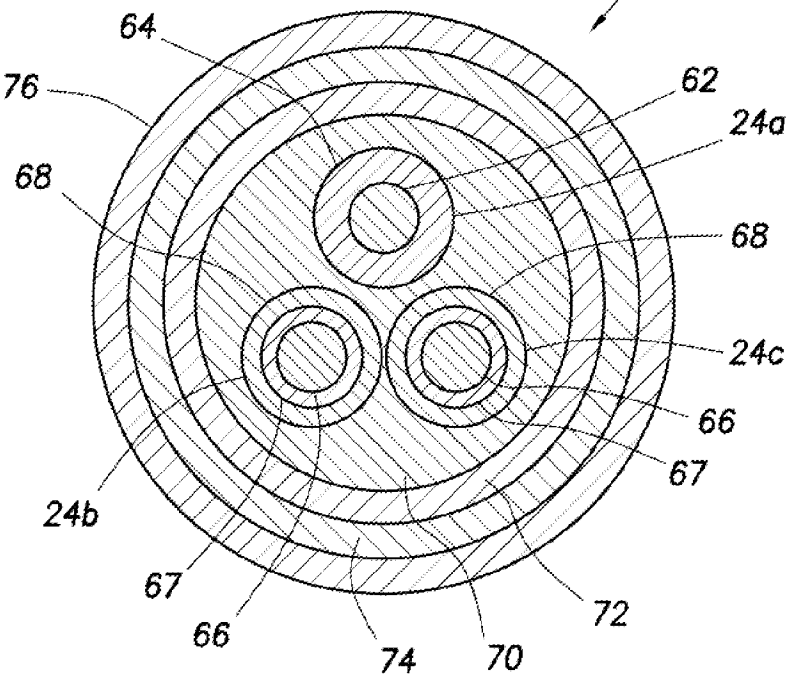
FIG. 6 is an enlarged scale schematic cross-sectional view of a cable which may be used in the well system.
Figure 7:
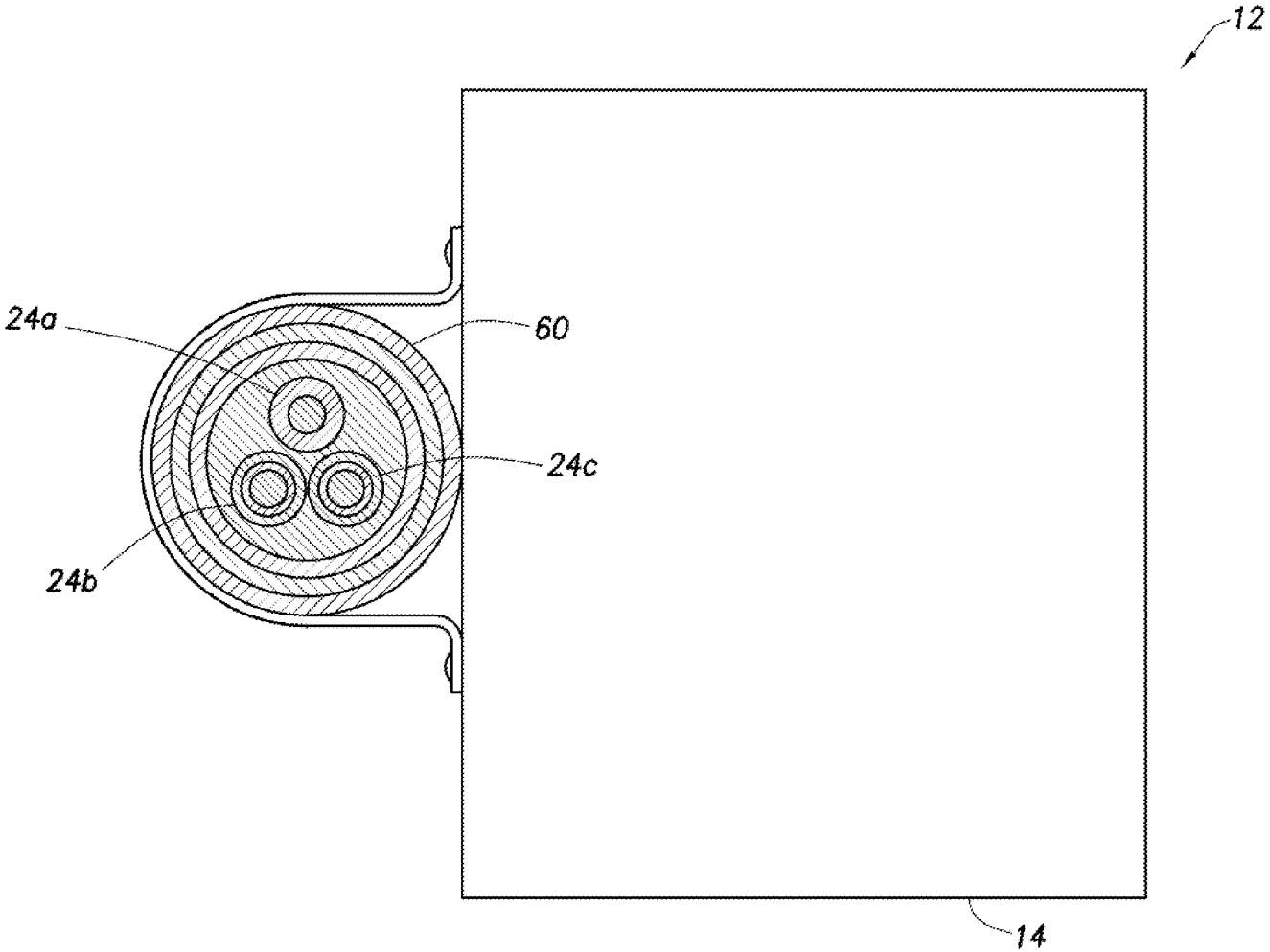
FIG. 7 is a schematic cross-sectional view of the cable of FIG. 6 attached to an object which transmits a signal to the cable.

Although only one sensing device 24 is depicted in FIG. 1, any number of sensing devices may be used. An example of three sensing devices 24*a-c* in a cable 60 of the sensing system 12 is depicted in FIGS. 6 & 7. The cable 60 may be used for the sensing device 24.

The objects 14 in the example of FIG. 1 are preferably of the type known to those skilled in the art as ball sealers, which are used to seal off perforations 28 for diversion purposes in fracturing and other types of stimulation operations. The perforations 28 provide fluid communication between the interior of the casing 18 and an earth formation 30 intersected by the wellbore 16.

It would be beneficial to be able to track the displacement of the objects 14 as they fall or are flowed with fluid through the casing 18. It would also be beneficial to know the position of each object 14, to determine which of the objects have located in appropriate perforations 28 (and thereby know which perforations remain open), to receive sensor measurements (such as pressure, temperature, pH, etc.) from the objects, etc.

Using the sensing device 24 as a sensor, transmissions from the objects 14 can be detected and the position, velocity, identity, etc. of the objects along the wellbore 16 can be known. Indications of parameters sensed by sensor(s) in the objects 14 can also be detected.

In one embodiment, the sensing device 24 can comprise one or more optical waveguides, and information can be transmitted acoustically from the objects 14 to the optical waveguides. For example, an acoustic signal transmitted from an object 14 to the sensing device 24 can cause vibration of an optical waveguide, and the location and other characteristics of the vibration can be detected by use of an interrogation system 32. The interrogation system 32 may detect Brillouin backscatter gain or coherent Rayleigh backscatter which results from light being transmitted through the optical waveguide.

The optical waveguide(s) may comprise optical fibers, optical ribbons or any other type of optical waveguides.

The optical waveguide(s) may comprise single mode or multi-mode waveguides, or any combination thereof.

The interrogation system 32 is optically connected to the optical waveguide at a remote location, such as the earth's surface, a sea floor or subsea facility, etc. The interrogation system 32 is used to launch pulses of light into the optical waveguide, and to detect optical reflections and backscatter indicative of data (such as identity of the object(s) 14) or parameters sensed by the sensing device 24, the sensors 26 and/or sensors of the objects 14. The interrogation system 32 can comprise one or more lasers, interferometers, photodetectors, optical time domain reflectometers (OTDR's) and/or other conventional optical equipment well known to those skilled in the art.

The sensing system 12 preferably uses a combination of two or more distributed optical sensing techniques. These techniques can include detection of Brillouin backscatter and/or coherent Rayleigh backscatter resulting from transmission of light through the optical waveguide(s). Raman backscatter may also be detected and, if used in conjunction with detection of Brillouin backscatter, may be used for thermally calibrating the Brillouin backscatter detection data in situations where accurate strain measurements are desired.

Optical sensing techniques can be used to detect static strain, dynamic strain, acoustic vibration and/or temperature. These optical sensing techniques may be combined with any other optical sensing techniques, such as hydrogen sensing, stress sensing, etc.

Most preferably, coherent Rayleigh backscatter is detected as an indication of vibration of an optical waveguide. Brillouin backscatter detection may be used to monitor static strain, with data collected at time intervals of a few seconds to hours.

Coherent Rayleigh backscatter is preferably used to monitor dynamic strain (e.g., acoustic pressure and vibration). Coherent Rayleigh backscatter detection techniques can detect acoustic signals which result in vibration of an optical waveguide.

The optical waveguide could include one or more waveguides for Brillouin backscatter detection, depending on the Brillouin method used (e.g., linear spontaneous or non-linear stimulated). The Brillouin backscattering detection technique measures the natural acoustic velocity via corresponding scattered photon frequency shift in a waveguide at a given location along the waveguide.

The frequency shift is induced by changes in density of the waveguide. The density, and thus acoustic velocity, can be affected primarily by two parameters—strain and temperature.

In long term monitoring, it is expected that the temperature will remain fairly stable. If the temperature is stable, any changes monitored with a Brillouin backscattering detection technique would most likely be due to changes in strain.

Preferably, however, accuracy will be improved by independently measuring strain and/or temperature, in order to calibrate the Brillouin backscatter measurements. An optical waveguide which is mechanically decoupled from the cement 20 and any other sources of strain may be used as an effective source of temperature calibration for the Brillouin backscatter strain measurements.

Raman backscatter detection techniques are preferably used for monitoring distributed temperature. Such techniques are known to those skilled in the art as distributed temperature sensing (DTS).

Raman backscatter is relatively insensitive to distributed strain, although localized bending in a waveguide can be detected. Temperature measurements obtained using Raman backscatter detection techniques can, therefore, be used for temperature calibration of Brillouin backscatter measurements.

Raman light scattering is caused by thermally influenced molecular vibrations. Consequently, the backscattered light carries the local temperature information at the point where the scattering occurred.

The amplitude of an Anti-Stokes component is strongly temperature dependent, whereas the amplitude of a Stokes component of the backscattered light is not. Raman backscatter sensing requires some optical-domain filtering to isolate the relevant optical frequency (or optical wavelength) components, and is based on the recording and computation of the ratio between Anti-Stokes and Stokes amplitude, which contains the temperature information.

Since the magnitude of the spontaneous Raman backscattered light is quite low (e.g., 10 dB less than Brillouin backscattering), high numerical aperture (high NA) multi-mode optical waveguides are typically used, in order to maximize the guided intensity of the backscattered light. However, the relatively high attenuation characteristics of highly doped, high NA, graded index multi-mode waveguides, in particular, limit the range of Raman-based systems to approximately 10 km.

Brillouin light scattering occurs as a result of interaction between the propagating optical signal and thermally excited acoustic waves (e.g., within the GHz range) present in silica optical material. This gives rise to frequency shifted components in the optical domain, and can be seen as the diffraction of light on a dynamic in situ "virtual" optical grating generated by an acoustic wave within the optical media. Note that an acoustic wave is actually a pressure wave which introduces a modulation of the index of refraction via the elasto-optic effect.

The diffracted light experiences a Doppler shift, since the grating propagates at the acoustic velocity in the optical media. The acoustic velocity is directly related to the silica media density, which is temperature and strain dependent. As a result, the so-called Brillouin frequency shift carries with it information about the local temperature and strain of the optical media.

Note that Raman and Brillouin scattering effects are associated with different dynamic non-homogeneities in silica optical media and, therefore, have completely different spectral characteristics.

Coherent Rayleigh light scattering is also caused by fluctuations or non-homogeneities in silica optical media density, but this form of scattering is purely "elastic." In contrast, both Raman and Brillouin scattering effects are "inelastic," in that "new" light or photons are generated from the propagation of the laser probe light through the media.

In the case of coherent Rayleigh light scattering, temperature or strain changes are identical to an optical source (e.g., very coherent laser) wavelength change. Unlike conventional Rayleigh backscatter detection techniques (using common optical time domain reflectometers), because of the extremely narrow spectral width of the laser source (with associated long coherence length and time), coherent Rayleigh (or phase Rayleigh) backscatter signals experience optical phase sensitivity resulting from coherent addition of amplitudes of the light backscattered from different parts of the optical media which arrive simultaneously at a photodetector.

In another embodiment, the sensing device 24 can comprise an electrical conductor, and information can be transmitted acoustically or electromagnetically from the objects 14 to the sensing device. For example, an acoustic signal can cause vibration of the sensing device 24, resulting in triboelectric noise or piezoelectric energy being generated in the sensing device. An electromagnetic signal can cause a current to be generated in the sensing device 24, in which case the sensing device serves as an antenna.

Triboelectric noise results from materials being rubbed together, which produces an electrical charge. Triboelectric noise can be generated by vibrating an electrical cable, which results in friction between the cable's various conductors, insulation, fillers, etc. The friction generates a surface electrical charge.

Piezoelectric energy can be generated in a coaxial electric cable with material such as polyvinylidene fluoride (PVDF) being used as a dielectric between an inner conductor and an outer conductive braid. As the dielectric material is flexed, vibrated, etc., piezoelectric energy is generated and can be sensed as small currents in the conductors.

If the sensing device 24 comprises an electrical conductor (in addition to, or instead of, an optical waveguide), then the interrogation system 32 may include suitable equipment to receive and process signals transmitted via the conductor. For example, the interrogation system 32 could include digital-to-analog converters, digital signal processing equipment, etc.

Figure 2:
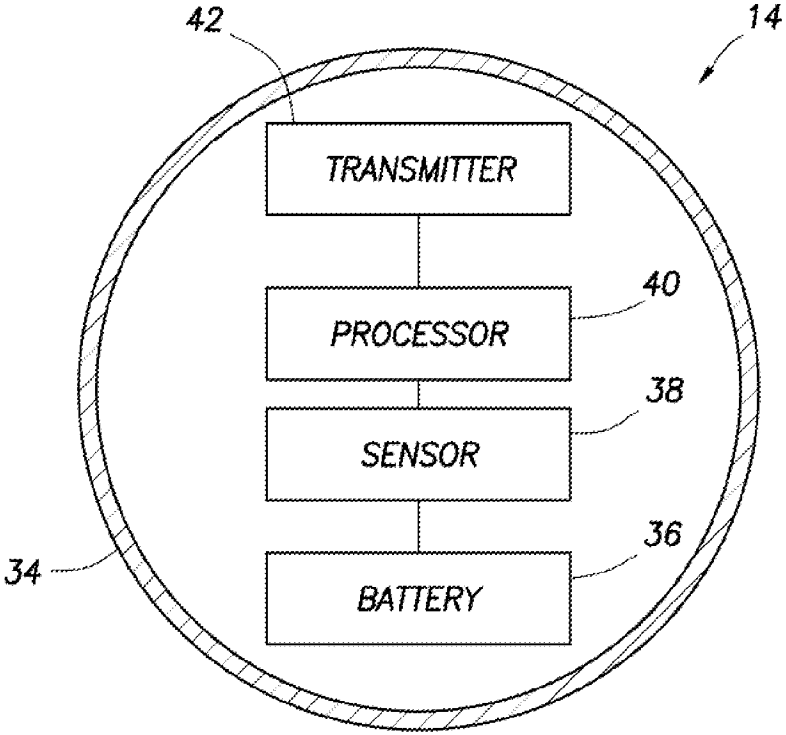
FIG. 2 is an enlarged scale schematic cross-sectional view of an object which may be used in the well system of FIG. 1.

Referring additionally now to FIG. 2, an enlarged scale schematic cross-sectional view of one of the objects 14 is representatively illustrated. In this view, it may be seen that the object 14 includes a generally spherical hollow body 34 having a battery 36, a sensor 38, a processor 40 and a transmitter 42 therein.

Note that the object 14 depicted in FIG. 2 is merely one example of a wide variety of different types of objects which can incorporate the principles of this disclosure. Thus, it should be understood that the principles of this disclosure are not limited at all to the particular object 14 illustrated in FIG. 2 and described herein, or to any of the other particular details of the system 10.

The battery 36 provides a source of electrical power for operating the other components of the object 14. The battery 36 is not necessary if, for example, a generator, electrical line, etc. is used to supply electrical power, electrical power is not needed to operate other components of the object 14, etc.

The sensor 38 measures values of certain parameters (such as pressure, temperature, pH, etc.). Any number or combination of pressure sensors, temperature sensors, pH sensors, or other types of sensors may be used in the object 14.

The sensor 38 is not necessary if measurements of one or more parameters by the object 14 are not used in the well system 10. For example, if it is desired only for the sensing system 12 to determine the position and/or identity of the object 14, then the sensor 38 may not be used.

The processor 40 can be used for various purposes, for example, to convert analog measurements made by the sensor 38 into digital form, to encode parameter measurements using various techniques (such as phase shift keying, amplitude modulation, frequency modulation, amplitude shift keying, frequency shift keying, differential phase shift keying, quadrature shift keying, single side band modulation, etc.), to determine whether or when a signal should be transmitted, etc. If it is desired only to determine the position and/or identity of the object 14, then the processor 40 may not be used. Volatile and/or non-volatile memory may be used with the processor 40, for example, to store sensor measurements, record the object's 14 identity (such as a serial number), etc.

The transmitter 42 transmits an appropriate signal to the sensing device 24 and/or sensors 26. If an acoustic signal is to be sent, then the transmitter 42 will preferably emit acoustic vibrations. For example, the transmitter 42 could comprise a piezoelectric driver or voice coil for converting electrical signals generated by the processor 40 into acoustic signals. The transmitter 42 could "chirp" in a manner which conveys information to the sensing device 24.

If an electromagnetic signal is to be sent, then the transmitter 42 will preferably emit electromagnetic waves.

For example, the transmitter 42 could comprise a transmitting antenna.

If only the position and/or identity of the object 14 is to be determined, then the transmitter 42 could emit a continuous signal, which is tracked by the sensing system 12. For example, a unique frequency or pulse rate of the signal could be used to identify a particular one of the objects 14. Alternatively, a serial number code could be continuously transmitted from the transmitter 42.

Figure 3:
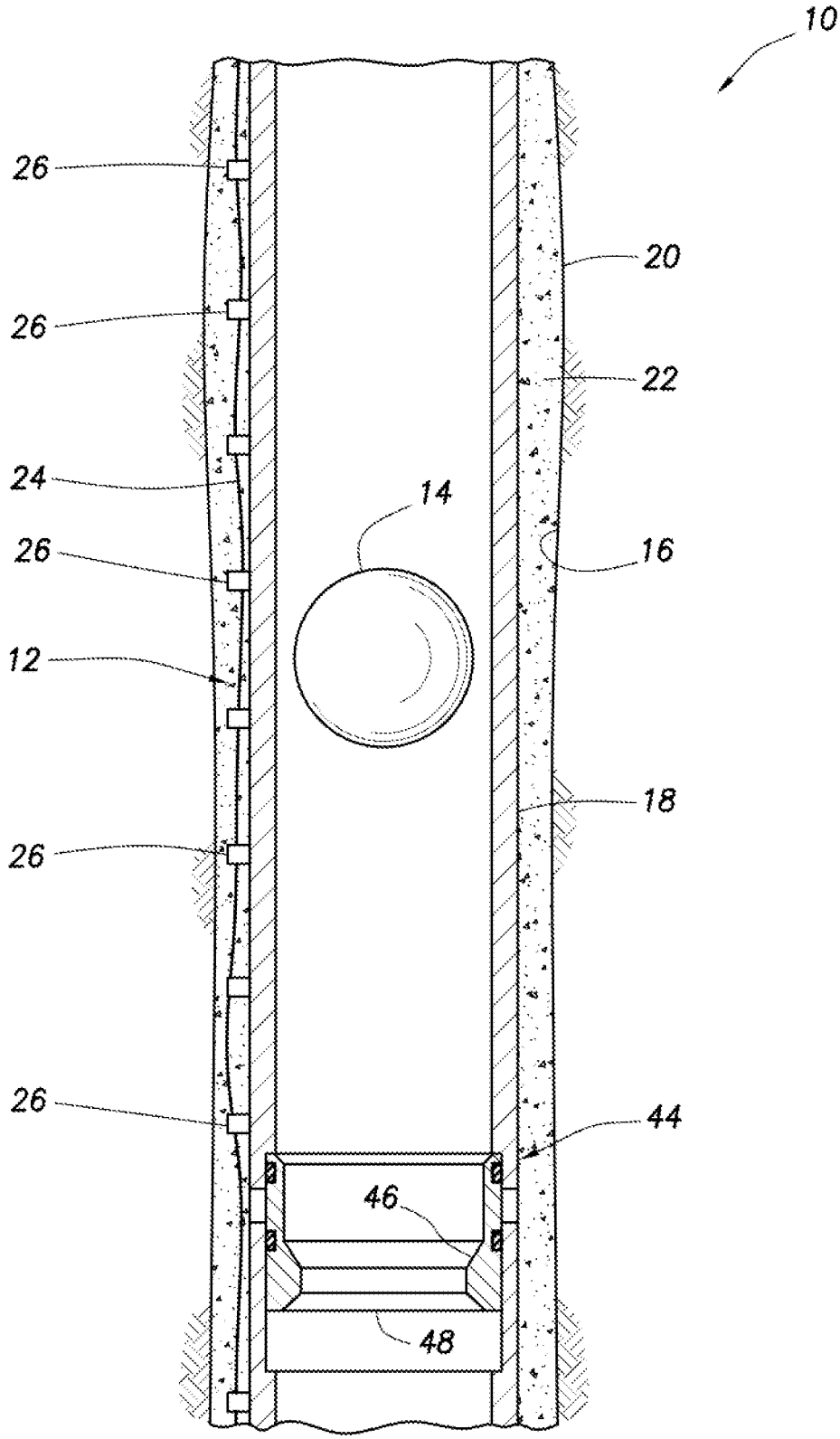
FIG. 3 is a schematic cross-sectional view of another configuration of the well system.

Referring additionally now to FIG. 3, another configuration of the well system 10 is representatively illustrated, in which the object 14 comprises a plugging device for operating a sliding sleeve valve 44. The configuration of FIG. 3 demonstrates that there are a variety of different well systems in which the features of the sensing system 12 can be beneficially utilized.

Using the sensing system 12, the position of the object 14 can be monitored as it displaces through the wellbore 16 to the valve 44. It can also be determined when or if the object 14 properly engages a seat 46 formed on a sleeve 48 of the valve 44.

It will be appreciated by those skilled in the art that many times different sized balls, darts or other plugging devices are used to operate particular ones of multiple valves or other well tools. The sensing system 12 enables an operator to determine whether or not a particular plugging device has appropriately engaged a particular well tool.

Figure 4:
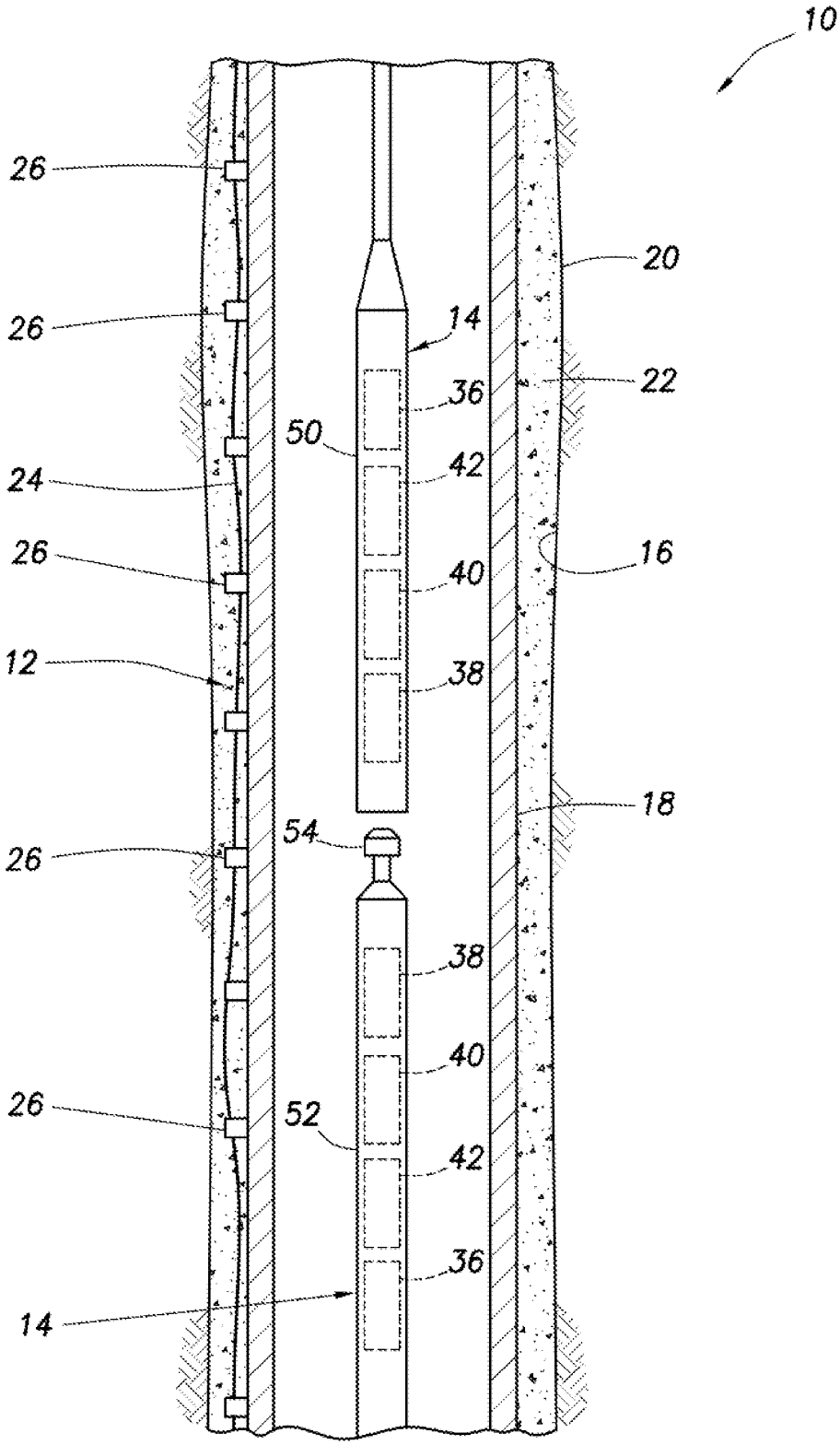
FIG. 4 is a schematic cross-sectional view of yet another configuration of the well system.

Referring additionally now to FIG. 4, another configuration of the well system 10 is representatively illustrated. In this configuration, the object 14 can comprise a well tool 50 (such as a wireline, slickline or coiled tubing conveyed fishing tool), or another type of well tool 52 (such as a "fish" to be retrieved by the fishing tool).

The sensor 38 in the well tool 50 can, for example, sense when the well tool 50 has successfully engaged a fishing neck 54 or other structure of the well tool 52. Similarly, the sensor 38 in the well tool 52 can sense when the well tool 52 has been engaged by the well tool 50. Of course, the sensors 38 could alternatively, or in addition, sense other parameters (such as pressure, temperature, etc.).

The position, identity, configuration, and/or any other characteristics of the well tools 50, 52 can be transmitted from the transmitters 42 to the sensing device 24, so that the progress of the operation can be monitored in real time from the surface or another remote location.

Figure 5:
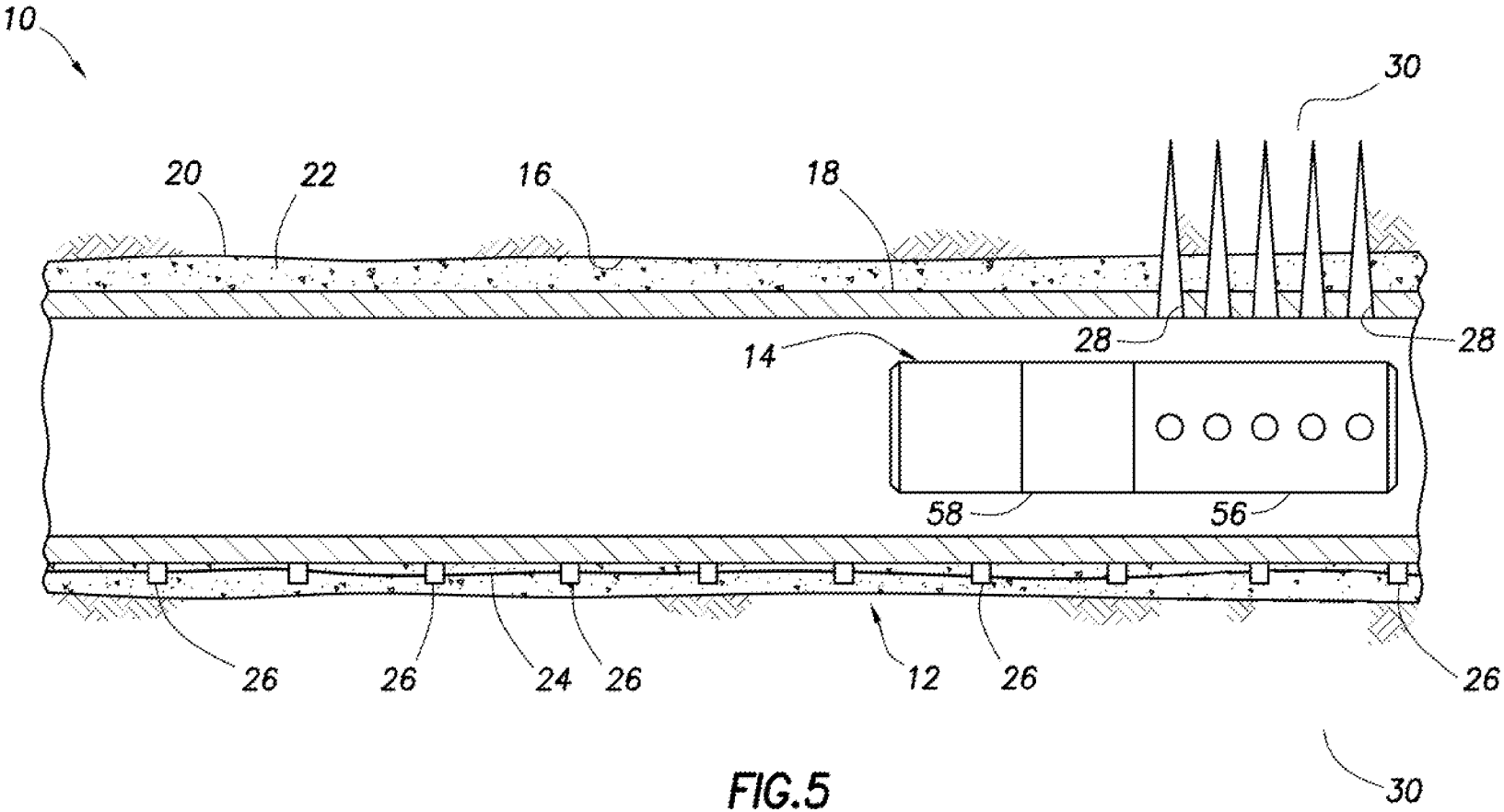
FIG. 5 is a schematic cross-sectional view of a further configuration of the well system.

Referring additionally now to FIG. 5, another configuration of the well system 10 is representatively illustrated. In this configuration, the object 14 comprises a perforating gun 56 and firing head 58 which are displaced through a generally horizontal wellbore 16 (such as, by pushing the object with fluid pumped through the casing 18) to an appropriate location for forming perforations 28.

The displacement, location, identity and operation of the perforating gun 56 and firing head 58 can be conveniently monitored using the sensing system 12. It will be appreciated that, as the object 14 displaces through the casing 18, it will generate acoustic noise, which can be detected by the sensing system 12. Thus, in at least this way, the displacement and position of the object 14 can be readily determined using the sensing system 12.

Furthermore, the transmitter 42 of the object 14 can be used to transmit indications of the identity of the object (such as its serial number), pressure and temperature, whether the firing head 58 has fired, whether charges in the perforating gun 56 have detonated, etc. Thus, it should be appreciated that the valve 44, well tools 50, 52, perforating gun 56 and firing head 58 are merely a few examples of a wide variety of well tools which can benefit from the principles of this disclosure.

Although in the examples of FIGS. 1 and 3-5 the object 14 is depicted as displacing through the casing 18, it should be clearly understood that it is not necessary for the object 14 to displace through any portion of the well during operation of the sensing system 12. Instead, for example, one or more of the objects 14 could be positioned in the annulus 22 (e.g., cemented therein), in a well screen or other component of a well completion, in a well treatment component, etc.

In the case of a permanent installation of the object 14 in the well, the battery 36 may have a limited life, after which the signal is no longer transmitted to the sensing device 24. Alternatively, electrical power could be supplied to the object 14 by a downhole generator, electrical lines, etc.

Referring additionally now to FIG. 6, one configuration of a cable 60 which may be used in the sensing system 12 is representatively illustrated. The cable 60 may be used for, in place of, or in addition to, the sensing device 24 depicted in FIGS. 1 & 3-5. However, it should be clearly understood that the cable 60 may be used in other well systems and in other sensing systems, and many other types of cables may be used in the well systems and sensing systems described herein, without departing from the principles of this disclosure.

The cable 60 as depicted in FIG. 6 includes an electrical line 24*a* and two optical waveguides 24*b,c*. The electrical line 24*a* can include a central conductor 62 enclosed by insulation 64. Each optical waveguide 24*b,c* can include a core 66 enclosed by cladding 67, which is enclosed by a jacket 68.

In one embodiment, one of the optical waveguides 24*b,c* can be used for distributed temperature sensing (e.g., by detecting Raman backscattering resulting from light transmitted through the optical waveguide), and the other one of the optical waveguides can be used for distributed vibration or acoustic sensing (e.g., by detecting coherent Rayleigh backscattering or Brillouin backscatter gain resulting from light transmitted through the optical waveguide).

The electrical line 24*a* and optical waveguides 24*b,c* are merely examples of a wide variety of different types of lines which may be used in the cable 60. It should be clearly understood that any types of electrical or optical lines, or other types of lines, and any number or combination of lines may be used in the cable 60 in keeping with the principles of this disclosure.

Enclosing the electrical line 24*a* and optical waveguides 24*b,c* are a dielectric material 70, a conductive braid 72, a barrier layer 74 (such as an insulating layer, hydrogen and fluid barrier, etc.), and an outer armor braid 76. Of course, any other types, numbers, combinations, etc., of layers may be used in the cable 60 in keeping with the principles of this disclosure.

Note that each of the dielectric material 70, conductive braid 72, barrier layer 74 and outer armor braid 76 encloses the electrical line 24*a* and optical waveguides 24*b,c* and, thus, forms an enclosure surrounding the electrical line and optical waveguides. In certain examples, the electrical line 24*a* and optical waveguides 24*b,c* can receive signals transmitted from the transmitter 42 through the material of each of the enclosures.

For example, if the transmitter 42 transmits an acoustic signal, the acoustic signal can vibrate the optical waveguides 24*b,c* and this vibration of at least one of the waveguides can be detected by the interrogation system 32. As another example, vibration of the electrical line 24*a* resulting from the acoustic signal can cause triboelectric noise or piezoelectric energy to be generated, which can be detected by the interrogation system 32.

Referring additionally now to FIG. 7, another configuration of the sensing system 12 is representatively illustrated. In this configuration, the cable 60 is not necessarily used in a wellbore.

As depicted in FIG. 7, the cable 60 is securely attached to the object 14 (which has the transmitter 42, sensor 38, processor 40 and battery 36 therein). The object 14 communicates with the cable 60 by transmitting signals to the electrical line 24*a* and/or optical waveguides 24*b,c* through the materials of the enclosures (the dielectric material 70, conductive braid 72, barrier layer 74 and outer armor braid 76) surrounding the electrical line and optical waveguides.

Thus, there is no direct electrical or optical connection between the sensor 38 or transmitter 42 of the object 14 and the electrical line 24*a* or optical waveguides 24*b,c* of the cable 60. One benefit of this arrangement is that connections do not have to be made in the electrical line 24*a* or optical waveguides 24*b,c*, thereby eliminating this costly and time-consuming step. Another benefit is that potential failure locations are eliminated (connections are high percentage failure locations). Yet another benefit is that optical signal attenuation is not experienced at each of multiple connections to the objects 14.

Figure 8:
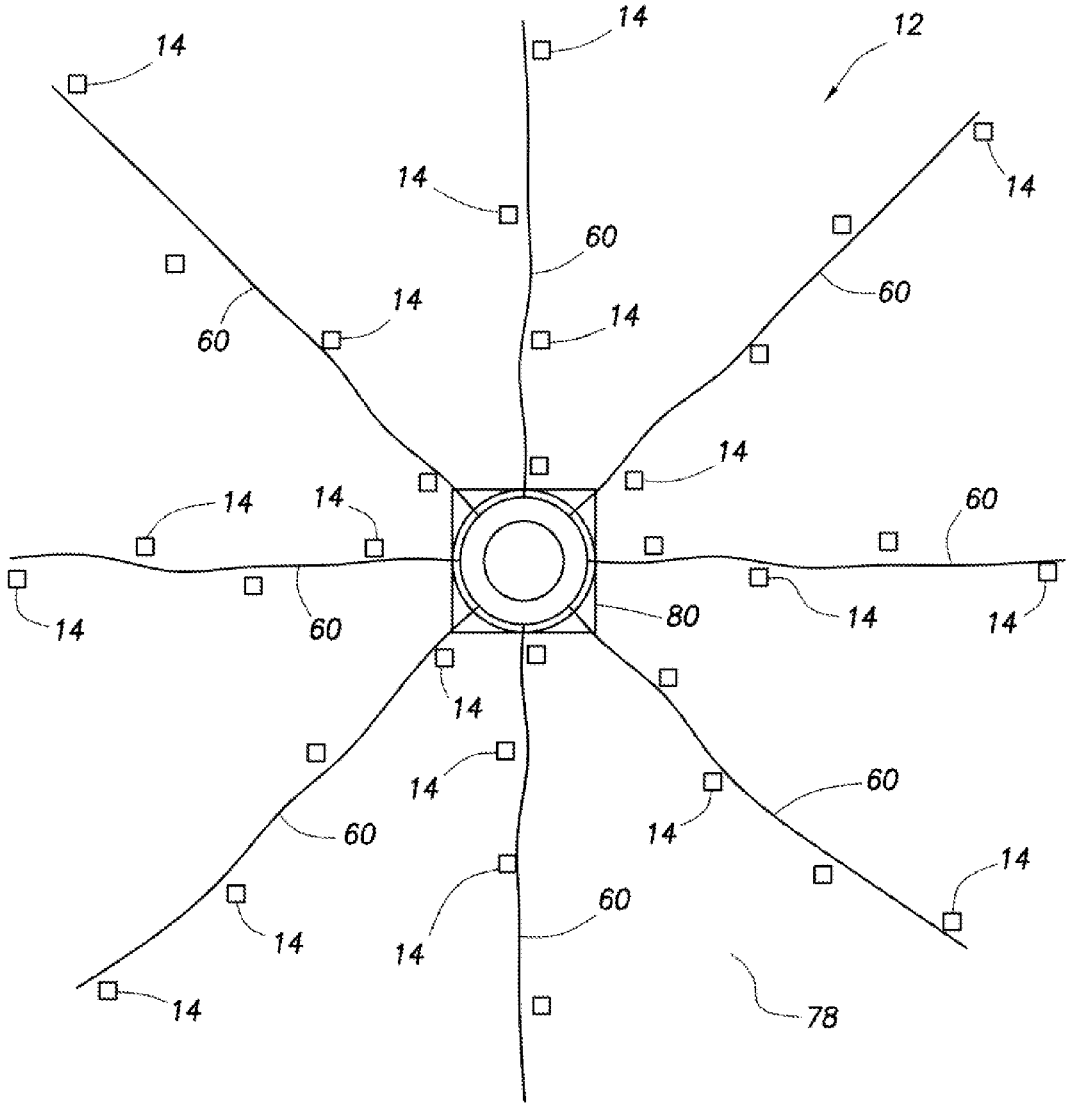
FIG. 8 is a schematic plan view of a sensing system which embodies principles of this disclosure.

Referring additionally now to FIG. 8, another configuration of the sensing system 12 is representatively illustrated. In this configuration, multiple cables 60 are distributed on a sea floor 78, with multiple objects 14 distributed along each cable. Although a radial arrangement of the cables 60 and objects 14 relative to a central facility 80 is depicted in FIG. 8, any other arrangement or configuration of the cables and objects may be used in keeping with the principles of this disclosure.

The sensors 38 in the objects 14 of FIGS. 7 & 8 could, for example, be tiltmeters used to precisely measure an angular orientation of the sea floor 78 at various locations over time. The lack of a direct signal connection between the cables 60 and the objects 14 can be used to advantage in this situation by allowing the cables and objects to be separately installed on the sea floor 78.

For example, the objects 14 could be installed where appropriate for monitoring the angular orientations of particular locations on the sea floor 78 and then, at a later time, the cables 60 could be distributed along the sea floor in close proximity to the objects (e.g., within a few meters). It would not be necessary to attach the cables 60 to the objects 14 (as depicted in FIG. 7), since the transmitter 42 of each object can transmit signals some distance to the nearest cable (although the cables could be secured to the objects, if desired).

As another alternative, the cables 60 could be installed first on the sea floor 78, and then the objects 14 could be installed in close proximity (or attached) to the cables. Another advantage of this system 12 is that the objects 14 can be individually retrieved, if necessary, for repair, maintenance, etc. (e.g., to replace the battery 36) as needed, without a need to disconnect electrical or optical connectors, and without a need to disturb any of the cables 60.

Instead of (or in addition to) tiltmeters, the sensors 38 in the objects 14 of FIGS. 7 & 8 could include pressure sensors, temperature sensors, accelerometers, or any other type or combination of sensors.

Note that, in the various examples described above, the sensing system 12 can receive signals from the object 14. Since acoustic noise may be generated by the object 14 as it displaces through the casing 18 in the example of FIGS. 1 and 3-5, the displacement of the object (or lack thereof) can be sensed by the sensing system 12 as corresponding acoustic vibrations are induced (or not induced) in the sensing device 24.

As another alternative, the object 14 could emit a thermal signal (such as an elevated temperature) when it has displaced to a particular location (such as, to a perforation in the example of FIG. 1, to the seat 46 in the example of FIG. 3, proximate a well tool 50, 52 in the example of FIG. 4, to a desired perforation location in the example of FIG. 5, etc.). The sensing device 24 can detect this thermal signal as an indication that the object 14 has displaced to the corresponding location.

For acoustic signals received by the sensing device 24, it is expected that data transmission rates (e.g., from the transmitter 42 to the sensing device) will be limited by the sampling rate of the interrogation system 32. Fundamentally, the Nyquist sampling theorem should be followed, whereby the minimum sampling frequency should be twice the maximum frequency component of the signal of interest. Therefore, if due to ultimate data flow volume file sizes and other electronic signal processing limitations, a preferred embodiment will sample photocurrents from an optical analog receiver at 10 kHz, then via Nyquist criteria, this will allow a maximum signal frequency of 5 kHz (or just less than 5 kHz). If the acoustic transmitter source "carrier," at 5 kHz (max), is modulated with baseband information, then the baseband information bandwidth will be limited to 2.5 k Baud (kbits/sec), assuming Manchester encoded clock, for example. Otherwise, the maximum signal information bandwith is just less than 5 kHz, or half of the electronic system sampling rate.

It may now be fully appreciated that the well system, sensing system and associated methods described above provide significant advancements to the art. In particular, the sensing system 12 allows the object 14 to communicate with the lines (electrical line 24*a* and optical waveguides 24*b,c*) in the cable 60, without any direct connections being made to the lines.

A sensing system 12 described above includes a transmitter 42 which transmits a signal, and at least one sensing device 24 which receives the signal. The sensing device 24 includes a line (such as electrical line 24*a* and/or optical waveguides 24*b,c*) contained in an enclosure (e.g., dielectric material 70, conductive braid 72, barrier layer 74 and armor braid 76). The signal is detected by the line 24*a-c* through a material of the enclosure.

The line can comprise an optical waveguide 24*b,c*. An interrogation system 32 may detect Brillouin backscatter gain or coherent Rayleigh backscatter resulting from light transmitted through the optical waveguide 24*b,c*.

The signal may comprise an acoustic signal. The acoustic signal may vibrate the line (such as electrical line 24*a* and/or optical waveguides 24*b,c*) through the enclosure material. An interrogation system 32 may detect triboelectric noise and/or piezoelectric energy generated in response to the acoustic signal.

The sensing device 24 may be positioned external to a casing 18, and the transmitter 42 may displace through an interior of the casing 18.

The signal may comprise an electromagnetic signal.

The transmitter 42 may not be attached directly to the sensing device 24, or the transmitter 42 may be secured to the sensing device 24.

The sensing device 24 may be disposed along a sea floor 78 in close proximity to the transmitter 42.

The sensing system 12 may further include a sensor 38, and the signal may include an indication of a parameter measured by the sensor 38.

The above disclosure provides to the art a sensing system 12 which can include at least one sensor 38 which senses a parameter, at least one sensing device 24 which receives an indication of the parameter, with the sensing device 24 including a line (such as 24*a-c*) contained in an enclosure (e.g., dielectric material 70, conductive braid 72, barrier layer 74 and armor braid 76), and a transmitter 42 which transmits the indication of the parameter to the line 24*a-c* through a material of the enclosure.

The line can comprise an optical waveguide 24*b,c*. An interrogation system 32 may detect Brillouin backscatter gain or coherent Rayleigh backscatter resulting from light transmitted through the optical waveguide 24*b,c*.

The transmitter 42 may transmit the indication of the parameter via an acoustic signal. The acoustic signal may vibrate the line 24*a-c* through the enclosure material.

The sensing device 24 may sense triboelectric noise or piezoelectric energy generated in response to the acoustic signal.

The sensing device 24 may be positioned external to a casing 18. The sensor 38 may displace through an interior of the casing 18.

The transmitter 42 may transmit the indication of the parameter via an electromagnetic signal.

The sensor 38 may not be attached to the sensing device 24, or the sensor 38 may be secured to the sensing device 24.

The sensing device 24 can be disposed along a sea floor 78 in close proximity to the sensor 38.

The sensor 38 may comprise a tiltmeter.

Also described by the above disclosure is a method of monitoring a parameter sensed by a sensor 38, with the method including positioning a sensing device 24 in close proximity to the sensor 38, and transmitting an indication of the sensed parameter to a line 24*a-c* of the sensing device 24, the indication being transmitted through a material of an enclosure (e.g., dielectric material 70, conductive braid 72, barrier layer 74 and armor braid 76) containing the line 24*a-c*.

The step of positioning the sensing device 24 may be performed after positioning the sensor 38 in a location where the parameter is to be sensed. Alternatively, positioning the sensing device 24 may be performed prior to positioning the sensor 38 in a location where the parameter is to be sensed.

Positioning the sensing device 24 may include laying the sensing device 24 on a sea floor 78.

The sensor 38 may comprise a tiltmeter.

The line 24*b,c* may comprise an optical waveguide.

The method may include the step of detecting Brillouin backscatter gain or coherent Rayleigh backscatter resulting from light transmitted through the optical waveguide.

The transmitting step may include transmitting the indication of the parameter via an acoustic signal. The acoustic signal may vibrate the line 24*a-c* through the enclosure material.

An interrogation system 32 may sense triboelectric noise or piezoelectric energy generated in response to the acoustic signal.

Positioning the sensing device 24 may include positioning the sensing device 24 external to a casing 18, and the sensor 38 may displace through an interior of the casing 18.

The transmitting step may include transmitting the indication of the parameter via an electromagnetic signal.

The sensor 38 may not be attached to the sensing device 24 in the transmitting step. Alternatively, the sensor 38 may be secured to the sensing device 24 in the transmitting step.

The above disclosure also describes a method of monitoring a parameter sensed by a sensor 38, with the method including positioning an optical waveguide 24*b,c* in close proximity to the sensor 38, and transmitting an indication of the sensed parameter to the optical waveguide 24*b,c*, the indication being transmitted acoustically through a material of an enclosure (e.g., dielectric material 70, conductive braid 72, barrier layer 74 and armor braid 76) containing the optical waveguide 24*b,c*.

Another sensing system 12 described above includes an object 14 which displaces in a subterranean well. At least one sensing device 24 receives a signal from the object 14. The sensing device 12 includes a line (such as electrical line 24*a* and/or optical waveguides 24*b,c*) contained in an enclosure, and the signal is detected by the line through a material of the enclosure.

The signal may be an acoustic signal generated by displacement of the object 14 through the well. The signal may be a thermal signal. The signal may be generated in response to arrival of the object 14 at a predetermined location in the well.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A sensing system, comprising:

a sensor;

a transmitter which transmits a signal, the signal including an indication of a parameter measured by the sensor; and at least one sensing device which receives the signal, the sensing device including a line contained in an enclosure, and the signal being detected by the line through a material of the enclosure.

2. The sensing system of claim 1, wherein the sensing device is positioned external to a casing, and wherein the transmitter displaces through an interior of the casing.

3. The sensing system of claim 1, wherein the signal comprises an electromagnetic signal.

4. The sensing system of claim 1, wherein the transmitter is not attached to the sensing device.

5. The sensing system of claim 1, wherein the transmitter is secured to the sensing device.

6. The sensing system of claim 1, wherein the sensing device is disposed along a sea floor in close proximity to the transmitter.

7. The sensing system of claim 1, wherein the line comprises an optical waveguide.

8. The sensing system of claim 7, wherein an interrogation system detects Brillouin backscatter gain resulting from light transmitted through the optical waveguide.

9. The sensing system of claim 7, wherein an interrogation system detects coherent Rayleigh backscatter resulting from light transmitted through the optical waveguide.

10. The sensing system of claim 1, wherein the signal comprises an acoustic signal.

11. The sensing system of claim 10, wherein the acoustic signal vibrates the line through the enclosure material.

12. The sensing system of claim 10, wherein an interrogation system detects triboelectric noise generated in response to the acoustic signal.

13. The sensing system of claim 10, wherein an interrogation system detects piezoelectric energy generated in response to the acoustic signal.

14. A sensing system, comprising:

at least one sensor which senses a parameter;

at least one sensing device which receives an indication of the parameter, the sensing device including a line contained in an enclosure; and a transmitter which transmits the indication of the parameter to the line through a material of the enclosure.

15. The sensing system of claim 14, wherein the transmitter transmits the indication of the parameter via an acoustic signal.

16. The sensing system of claim 14, wherein the sensing device is positioned external to a casing, and wherein the sensor displaces through an interior of the casing.

17. The sensing system of claim 14, wherein the transmitter transmits the indication of the parameter via an electromagnetic signal.

18. The sensing system of claim 14, wherein the sensor is not attached to the sensing device.

19. The sensing system of claim 14, wherein the sensor is secured to the sensing device.

20. The sensing system of claim 14, wherein the sensing device is disposed along a sea floor in close proximity to the sensor.

21. The sensing system of claim 14, wherein the sensor comprises a tiltmeter.

22. The sensing system of claim 14, wherein the line comprises an optical waveguide.

23. The sensing system of claim 22, wherein an interrogation system detects Brillouin backscatter gain resulting from light transmitted through the optical waveguide.

24. The sensing system of claim 22, wherein an interrogation system detects coherent Rayleigh backscatter resulting from light transmitted through the optical waveguide.

25. The sensing system of claim 15, wherein an interrogation system detects piezoelectric energy generated in response to the acoustic signal.

26. The sensing system of claim 15, wherein the acoustic signal vibrates the line through the enclosure material.

27. The sensing system of claim 15, wherein an interrogation system detects triboelectric noise generated in response to the acoustic signal.

28. A sensing system, comprising:

an object which displaces in a subterranean well;

at least one sensing device which receives a signal from the object, the sensing device including a line contained in an enclosure, and the signal being detected by the line through a material of the enclosure; and a sensor, wherein the signal includes an indication of a parameter measured by the sensor.

29. The sensing system of claim 28, wherein the signal comprises a thermal signal.

30. The sensing system of claim 28, wherein the signal is generated in response to arrival of the object at a predetermined location in the well.

31. The sensing system of claim 28, wherein the line comprises an optical waveguide.

32. The sensing system of claim 31, wherein an interrogation system detects Brillouin backscatter gain resulting from light transmitted through the optical waveguide.

33. The sensing system of claim 31, wherein an interrogation system detects coherent Rayleigh backscatter resulting from light transmitted through the optical waveguide.

34. The sensing system of claim 28, wherein the signal comprises an acoustic signal.

35. The sensing system of claim 34, wherein the acoustic signal vibrates the line through the enclosure material.

36. The sensing system of claim 34, wherein an interrogation system detects triboelectric noise generated in response to the acoustic signal.

37. The sensing system of claim 34, wherein an interrogation system detects piezoelectric energy generated in response to the acoustic signal.

38. The sensing system of claim 34, wherein the acoustic signal is generated by displacement of the object through the well.

* * * * *

UNITED STATES PATENT AND TRADEMARK OFFICE

CERTIFICATE OF CORRECTION

PATENT NO. : 8,584,519 B2
APPLICATION NO. : 12/838736
DATED : November 19, 2013
INVENTOR(S) : John L. Maida, Jr. and Etienne M. Samson It is certified that error appears in the above-identified patent and that said Letters Patent is hereby corrected as shown below:

Title page, Item 12, delete "Maida", and replace with -- Maida, Jr. --.

Title page, Item 75, Inventors:, cancel "Maida," and insert in place thereof -- Maida, Jr., --.

Signed and Sealed this
Eleventh Day of March, 2014

Michelle K. Lee

Michelle K. Lee
*Deputy Director of the United States Patent and Trademark Office*